US009686851B2

(12) United States Patent
Nutt et al.

(10) Patent No.: US 9,686,851 B2
(45) Date of Patent: Jun. 20, 2017

(54) RADIOISOTOPE TARGET ASSEMBLY

(71) Applicant: ABT Molecular Imaging, Inc., Knoxville, TN (US)

(72) Inventors: Ronald Nutt, Friendsville, TN (US); David Patton, Sr., Maryville, TN (US); Darrell Swicegood, Maryville, TN (US); John McCracken, Knoxville, TN (US); Mark Haig Khachaturian, Louisville, TN (US)

(73) Assignee: ABT Molecular Imaging Inc., Knoxville, TN (US)

( * ) Notice: Subject to any disclaimer, the term of this patent is extended or adjusted under 35 U.S.C. 154(b) by 328 days.

(21) Appl. No.: 14/604,192

(22) Filed: Jan. 23, 2015

(65) Prior Publication Data

US 2015/0170775 A1 Jun. 18, 2015

Related U.S. Application Data

(63) Continuation-in-part of application No. 13/248,906, filed on Sep. 29, 2011, now abandoned.

(51) Int. Cl.

| | |
|---|---|
| ***H05H 6/00*** | (2006.01) |
| ***G21K 5/08*** | (2006.01) |
| *G21G 1/10* | (2006.01) |

(52) U.S. Cl.

CPC ..... *H05H 6/00* (2013.01); *G21K 5/08* (2013.01); *G21G 1/10* (2013.01)

(58) Field of Classification Search

CPC .. G21G 1/10; G21K 5/00; G21K 5/08; G21K 5/10; G21K 2201/064; H05H 6/00; H05H 2006/002

See application file for complete search history.

(56) References Cited

U.S. PATENT DOCUMENTS

| | | | |
|---|---|---|---|
| 3,940,318 | A | 2/1976 | Arino et al. |
| 4,818,468 | A | 4/1989 | Jungerman et al. |
| 5,395,300 | A | 3/1995 | Liprie |
| 5,917,874 | A | 6/1999 | Schlyer et al. |
| 6,011,325 | A | 1/2000 | Goldberg et al. |
| 6,586,747 | B1 | 7/2003 | Erdman |
| 7,200,198 | B2 | 4/2007 | Wieland et al. |
| 2003/0006379 | A1 | 1/2003 | Hino et al. |
| 2005/0084055 | A1 | 4/2005 | Alvord |

(Continued)

OTHER PUBLICATIONS

Micheal J. Welch, Carol S. Redvanly: Handbook of Radiopharmaceuticals: Radiochemistry and Applications, Oct. 1, 2005 John Wiley & Sons, USA, XP002738694 p. 79, line 18-21.

(Continued)

*Primary Examiner* — Jack W Keith
*Assistant Examiner* — Sharon M Davis
(74) *Attorney, Agent, or Firm* — Pitts & Lake, P.C.

(57) ABSTRACT

A target assembly to produce radioisotopes for the synthesis of radiopharmaceuticals. The target assembly includes a target vessel with a target chamber adapted to receive a target material. A thin cover sheet of particle-permeable material covers the target chamber. In a bombardment process, a high-energy particle beam generated by a cyclotron or particle accelerator strikes the thin cover sheet, whereby at least some of the particles from the particle beam penetrate to the target chamber so as to interact with the target material, altering the nuclear makeup of some of the atoms in the target material to produce radioisotopes.

15 Claims, 10 Drawing Sheets

(56) References Cited

U.S. PATENT DOCUMENTS

| | | | |
|---|---|---|---|
| 2005/0221358 | A1 | 10/2005 | Carrillo et al. |
| 2006/0050832 | A1 | 3/2006 | Buckley |
| 2006/0104401 | A1 | 5/2006 | Jongen et al. |
| 2009/0090875 | A1 | 4/2009 | Gelbart et al. |
| 2010/0127188 | A1 | 5/2010 | Nutt |

OTHER PUBLICATIONS

Patent Cooperation Treaty, International Search Report, EPO Form 1507S, Date of Mailing May 7, 2015.

Fosshag et al. "A target system for the production of 15O beams for ISAC." Published in: Nuclear Instruments and methods in Physics research A 481 (2002).

RADIOISOTOPE TARGET ASSEMBLY

CROSS-REFERENCE TO RELATED APPLICATIONS

This Application is a continuation-in-part of U.S. patent application Ser. No. 13/248,906, filed Sep. 29, 2011, the entire content of which is incorporated herein by reference.

STATEMENT REGARDING FEDERALLY-SPONSORED RESEARCH OR DEVELOPMENT

Not Applicable

BACKGROUND OF THE INVENTION

1. Field of Invention

The present general inventive concept relates to an apparatus and method to bombard a nucleus with charged particles so as to bring about a change in the nucleus resulting in a different isotope of the original nucleus or in a different element; and more particularly, to an apparatus to position a target material in the path of a stream of charged particles in order to produce a radioisotope for use in a radiopharmaceutical.

2. Description of the Related Art

A biomarker is used to interrogate a biological system and can be created by "tagging" or labeling certain molecules, including biomolecules, with a radioisotope. A biomarker that includes a positron-emitting radioisotope is required for positron-emission tomography (PET), a noninvasive diagnostic imaging procedure that is used to assess perfusion or metabolic, biochemical and functional activity in various organ systems of the human body. Because PET is a very sensitive biochemical imaging technology and the early precursors of disease are primarily biochemical in nature, PET can detect many diseases before anatomical changes take place and often before medical symptoms become apparent. PET is similar to other nuclear medicine technologies in which a radiopharmaceutical is injected into a patient to assess metabolic activity in one or more regions of the body. However, PET provides information not available from traditional imaging technologies, such as magnetic resonance imaging (MRI), computed tomography (CT) and ultrasonography, which image the patient's anatomy rather than physiological images. Physiological activity provides a much earlier detection measure for certain forms of disease, cancer in particular, than do anatomical changes over time.

A positron-emitting radioisotope undergoes radioactive decay, whereby its nucleus emits positrons. In human tissue, a positron inevitably travels less than a few millimeters before interacting with an electron, converting the total mass of the positron and the electron into two photons of energy. The photons are displaced at approximately 180 degrees from each other, and can be detected simultaneously as "coincident" photons on opposite sides of the human body. The modern PET scanner detects one or both photons, and computer reconstruction of acquired data permits a visual depiction of the distribution of the isotope, and therefore the tagged molecule, within the organ being imaged.

Most clinically-important positron-emitting radioisotopes are produced in a cyclotron. Cyclotrons operate by accelerating electrically-charged particles along outward, quasi-spherical orbits to a predetermined extraction energy generally on the order of millions of electron volts. The high-energy electrically-charged particles form a continuous beam that travels along a predetermined path and bombards a target. When the bombarding particles interact in the target, a nuclear reaction occurs at a sub-atomic level, resulting in the production of a radioisotope. The radioisotope is then combined chemically with other materials to synthesize a radiochemical or radiopharmaceutical suitable for introduction into a human body.

FIGS. 1 and 2 depict a conventional cyclotron used for the production of radioisotopes. As shown in FIG. 2, the cyclotron 6 includes an array of four "D" electrodes, also known as "dees" 61. The dees 61 are positioned in the valleys 62 of a large electromagnet 63. As shown in FIG. 1 and in the exploded view of the same cyclotron in FIG. 2, during operation of the cyclotron 6, an ion source continuously generates charged particles and introduces them into the cyclotron 6 at the center of the array of dees 61. The charged particles are exposed to a strong magnetic field generated by opposing magnet poles situated above and below the array of dees 61. A radio frequency (RF) oscillator applies a high frequency, high voltage signal to each of the dees 61 causing the charge of the electric potential developed across each of the dees 61 to alternate at a high frequency. Neighboring dees 61 are given opposite charges such that charged particles entering the gap between neighboring dees 61 see a like charge on one neighboring dee 61 and an opposite charge on the other neighboring dee 61, which results in acceleration (i.e., increasing the energy) of the charged particles. With each energy gain, the orbital radius of the charged particles increases. The result is a stream of charged particles A following an outwardly spiraling path away from the center of the array of dees 61. The charged particles ultimately exit the cyclotron 6 as a particle beam B directed at a target 11.

As shown in FIGS. 1 and 2, the particle beam B leaves the magnetic field of the cyclotron 6 before passing through a beam tube 91 and a collimator 93 to strike a target 11. The beam tube 91 and collimator 93 help to keep the particle beam focused after it leaves the magnetic field of the cyclotron 6. FIG. 3 shows an exploded view of a cyclotron 6' in use with an internal target 11'—that is, a target that is positioned within the magnetic field of the electromagnet 63, so that a particle beam B' generated by the cyclotron 6' does not need to leave the magnetic field of the electromagnet 63 before striking the target 11'. Such an internal target has certain advantages over an external target. When using an external target, the particle beam loses some energy and concentrated power as it travels the distance between the cyclotron and the external target. Using an internal target, on the other hand, avoids this loss of beam energy and focus since the particle beam does not leave the immediate area of the cyclotron. This means that the particle stream generated by the cyclotron need not be as highly energetic as would be the case if it were necessary to compensate for a loss of beam energy and focus over distance. Therefore, using an internal target to position a target material in the path of the particle beam allows for the use of a smaller, less powerful cyclotron, with less attendant radiation and less need for shielding or extensive physical plant. Further, the elimination of the beam tube and collimator results in fewer total components contaminated by radiation.

BRIEF SUMMARY OF THE INVENTION

The present general inventive concept is directed toward a target assembly for use with a cyclotron in producing radioisotopes for the synthesis of radiopharmaceuticals. The cyclotron accelerates small charged particles, such as protons, deuterons or helium nuclei, to form a high-energy particle beam. The particle beam then strikes a designated target area on the target assembly so as to interact with a target substance (i.e. the "target material"). The interaction with the charged particle beam alters the nuclear makeup of some of the atoms in the target material, thereby producing radioisotopes. These radioisotopes will in short time decay, emitting positrons or other energy signatures in the process. When incorporated into radiopharmaceutical molecules, these radioisotopes have useful medical applications, for instance in positron emission tomography (PET).

The target assembly includes a target vessel defining a target chamber adapted to receive target material. A thin sheet of particle-permeable material covers the target chamber and is welded to the target vessel. A target material input is provided in fluid communication with the target chamber to deliver a target material to the target chamber. A cooling system is provided in communication with the target assembly. During a bombardment process, the cooling system keeps the target vessel from overheating while a particle beam from a cyclotron strikes the target material within the target chamber, thereby transforming the target material to contain a radioisotope. A gas supply is provided to keep the target material under pressure in the target chamber during the bombardment process. Following the bombardment process, the transformed target material is evacuated from the target chamber and directed to a chemical processing unit, where at least a portion of the radioisotopes formed within the transformed target material are combined with other reagents to synthesize a radiopharmaceutical. One unique aspect of this design is that there is no beam post and the target window wraps around the target face. This provides a number of design advantages which include less beam attenuation since there is no beam post, and less heat being deposited in the part of the window that wraps around (i.e., is substantially parallel to the beam). This reduces the cooling load of the target and allows for higher beam current operation. The larger beam current results in more radioisotope production which improves the yield and allows for a lower energy cyclotron which emits less radiation.

In many embodiments of the present invention, the target material used is heavy water—i.e. $H_2O$ molecules in which the oxygen atom consists of the O-18 isotope. Likewise, in many embodiments of the present invention, the radioisotope produced by the bombardment process is the F-18 isotope of fluorine. However, the present invention contemplates the use of other target materials with the present invention, and the production of other radioisotopes.

In some embodiments of the present general inventive concept, a target assembly to produce a radioisotope from a target material includes a target vessel having a body fabricated from a single piece of material, said target vessel defining a target chamber to hold the target material and to position the target material in the path of a beam of charged particles, whereby when the charged particles interact with the target material in said target chamber, at least one radioisotope is formed; and a support structure to deliver target material to said target chamber, to pressurize the target material within said target chamber, to remove radioisotopes from said target chamber, and to cool said target vessel.

In some embodiments, the target chamber defines a window at least partially covered by a sheet of particle-permeable material, said sheet being positioned to allow the beam of charged particles to penetrate the sheet to bombard the target material, said sheet wrapping around said target chamber.

In some embodiments, the sheet of particle-permeable material is welded to said target vessel.

In some embodiments, the sheet of particle-permeable material is fabricated from a material selected from the group consisting of HAVAR, ARNAVAR, and aluminum.

In some embodiments, the sheet of particle-permeable material is secured to said target vessel by a clamp and gasket.

In some embodiments, the body of said target vessel is formed from stainless steel, tantalum, or molybdenum.

In some embodiments, the body of said target vessel is formed from a material capable a withstanding without compromising deformation pressures of up to 250 pounds per square inch.

In some embodiments, the body of said target vessel is formed from stainless steel, tantalum, or molybdenum.

In some embodiments, the body of said target vessel is formed a material exhibiting thermal conductivity of at least 12 Watts per meter per Kelvin.

In some embodiments of the present general inventive concept, a target assembly to produce a radioisotope from a target material encompasses a target vessel having a body fabricated from a single piece of material, said target vessel including a target chamber for holding the target material and for positioning the target material in the path of a beam of charged particles, whereby when the charged particles interact with the target material in said target chamber, radioisotopes are formed, said target chamber being covered on at least one side by a window piece fabricated from of material adapted to withstand the impact of a beam of charged particles, said window piece being positioned to cover an area directly in the path of the beam of charged particles, said window piece being adapted to permit the through passage of at least some charged particles, whereby when the beam of charged particles comes into contact with said window piece at least some charged particles in the beam of charged particles pass through said window piece to interact with the target material in said target chamber, said window piece wrapping around the target chamber; and a support structure for delivering target material to said target chamber, for pressurizing the target material within said target chamber, for removing radioisotopes from said target chamber, and for cooling said target vessel.

In some embodiments, the window piece is fabricated from HAVAR.

In some embodiments, the window piece is fabricated from ARNAVAR.

In some embodiments, the body of said target vessel is formed from stainless steel, tantalum, or molybdenum.

In some embodiments, the target vessel is fabricated from material capable of withstanding deformation pressures of up to 250 pounds per square inch.

In some embodiments, the target vessel is fabricated from material exhibiting a thermal conductivity of at least 12 Watts per meter per Kelvin.

In some embodiments of the present general inventive concept, a target assembly to produce a radioisotope from a target material includes a target chamber to hold the target material and to position the target material in the path of a beam of high-energy particles, and a window piece that wraps around the target chamber such that, when the target assembly is maneuvered into a particular rotational position relative to the path of the beam of high-energy particles, part of the window piece is substantially perpendicular to the path of the beam and another part of the window piece is substantially parallel to the path of the beam, and the beam impinges near where the window piece curves to wrap around the target chamber.

In some embodiments, the target assembly is configured such that a portion of the beam of high-energy particles can propogate past the part of the window piece that is substantially parallel to the path of the beam.

In some embodiments, the target assembly is configured such that a portion of the beam of high-energy particles can propogate past the part of the window piece that is substantially parallel to the path of the beam, there being no post to impede or interdict the beam (as is found in some prior art).

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A target assembly for use with a cyclotron or accelerator in producing radioisotopes for the synthesis of radiopharmaceuticals is described more fully herein. The invention may be embodied in many different forms and should not be construed as limited to the embodiments set forth herein.

Figure 1:
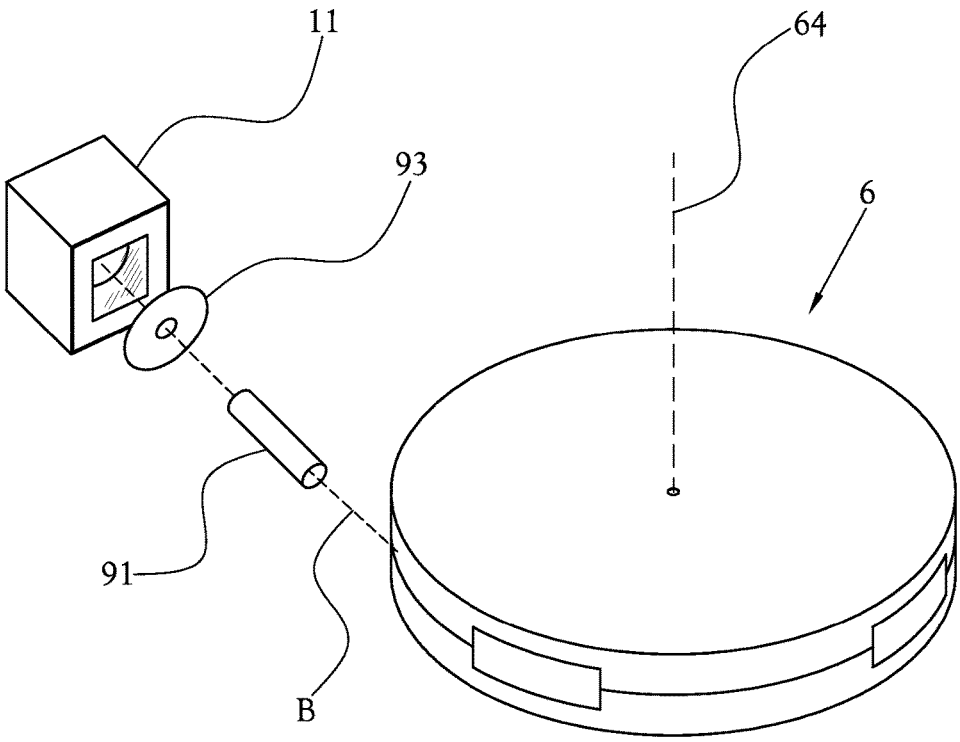
Fig.1 (RELATED ART)
FIG. 1 is a schematic illustration of a cyclotron directing a beam of charged particles toward an external target.
Figure 2:
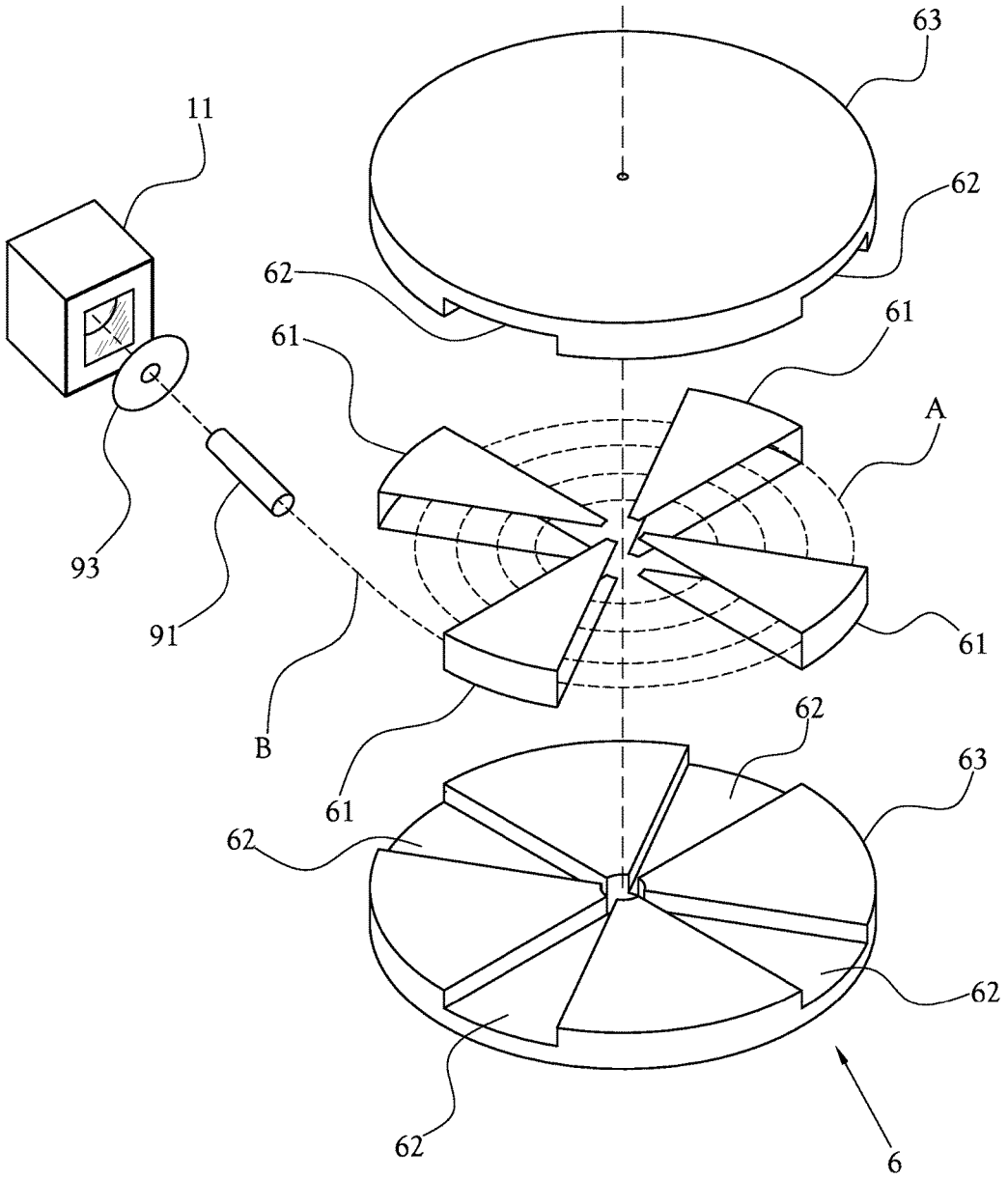
Fig.2 (RELATED ART)
FIG. 2 is an exploded view of the cyclotron system shown in FIG. 1.
Figure 3:
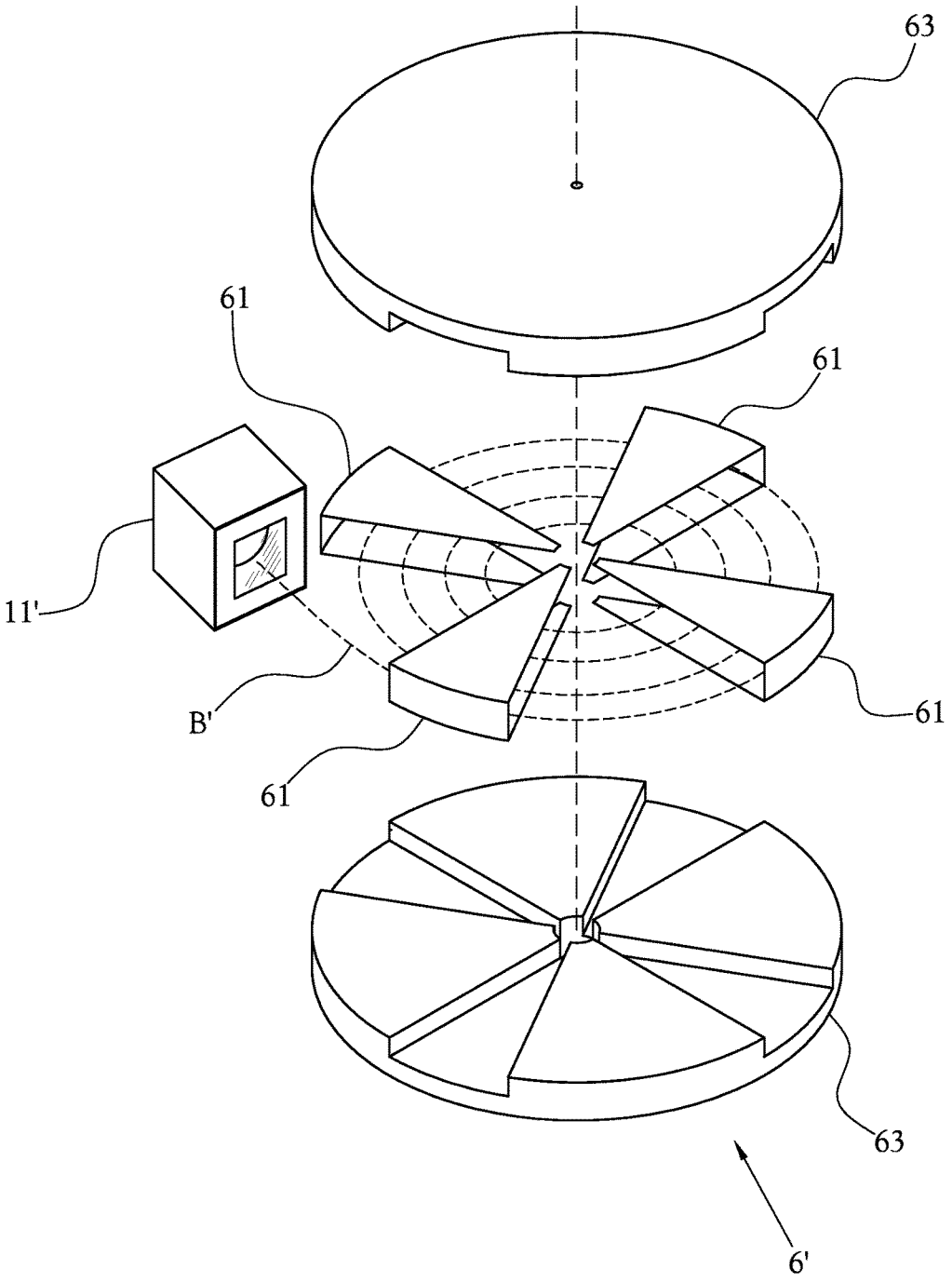
Fig.3 (RELATED ART)
FIG. 3 is an exploded view of a cyclotron system directing a beam of charged particles toward an internal target.
Figure 4:
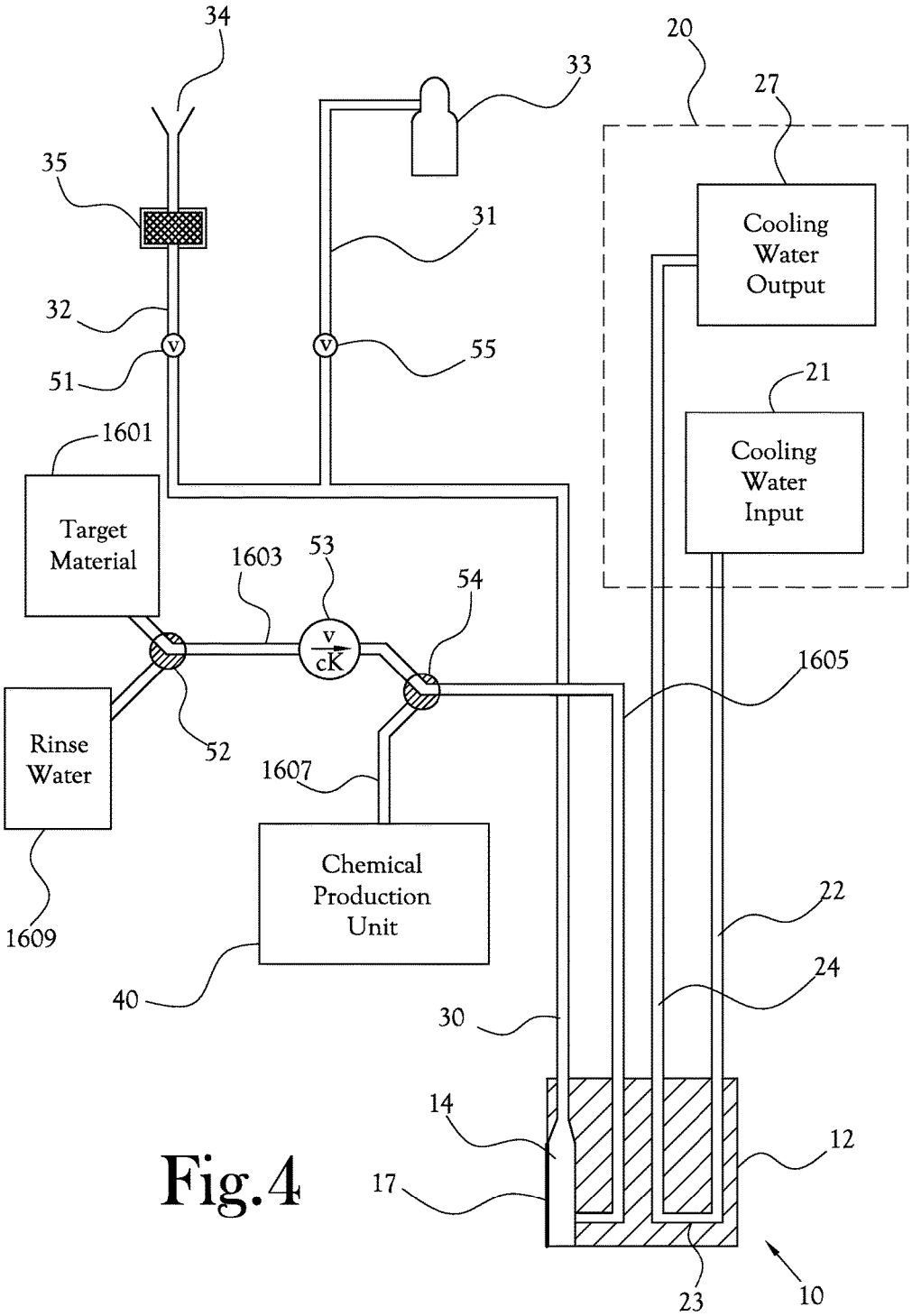
FIG. 4 is a schematic diagram of one embodiment of the target assembly.

FIG. 4 is a schematic diagram showing one embodiment of the present invention. Referring to FIG. 4, a target assembly 10 is provided which includes a target vessel 12 and other components used to deliver materials to or from the target vessel 12 as will be described further below. The target vessel 12 is fabricated from a material having sufficient heat tolerance and sufficient structural strength to allow the target vessel 12 to maintain integrity without significant deformation during a process of bombardment of target material within the target vessel 12 by a cyclotron to produce a radioisotope ("the bombardment cycle"). The target vessel 12 defines a target chamber 14 adapted to hold a target material, such as heavy water. The target vessel 12 further defines a window on at least one side of the target chamber 14. The window is covered with a thin sheet 17 of metal or similar particle-permeable material. The window and cover sheet 17 are adapted to allow high-energy particles to enter the target chamber 14 and bombard a target material held within the target chamber 14 to produce at least one radioisotope. In several embodiments, the window and cover sheet 17 are positioned such that, when the target assembly 10 undergoes the bombardment cycle, the window and cover sheet 17 are most directly in the path of the particle stream within the cyclotron. In many embodiments of the present invention, the cover sheet 17 is welded to the body of the target vessel. The material forming the cover sheet 17 is selected to have physical properties permitting the through passage of charged particles (i.e. "particle-permeable") sufficient to allow at least a percentage of charged particles in the particle stream to pass through the cover sheet 17 to interact with the target material held within the target chamber 14. In some embodiments, the cover sheet 17 is fabricated from a metal such as aluminum. In other embodiments, the cover sheet is fabricated from a material selected from the group consisting of HAVAR® and ARNAVAR. In several embodiments, the cover sheet 17 is secured to the target vessel 12 so as to ensure that liquid does not leak from the target chamber 14 through the window. In several embodiments, the cover sheet 17 is welded to the target vessel 12. In several embodiments, the target assembly 10 is designed so that it can be used as an internal target with a cyclotron.

Referring to FIG. 4, a target material input 1601 is provided in fluidic communication with the target chamber 14 to allow delivery of a target material to the target chamber 14. A rinse water storage compartment 1609 is also provided in fluidic communication with the target chamber 14 to supply rinse water to the target chamber 14. In the illustrated embodiment, the target chamber 14 is in fluidic communication with a load/unload tube 1605, which is connected to a delivery valve 54. The delivery valve 54 is, in turn, connected to a fill tube 1603 and a delivery tube 1607 and is configured to allow selective fluidic communication of the load/unload tube 1605 between the fill tube 1603 and the delivery tube 1607. The delivery tube 1607 leads to a chemical production unit 40 as will be discussed further below. The fill tube 1603 is in fluidic communication with a water intake valve 52. The water intake valve 52 is, in turn, connected to the target material input 1601 and a rinse water storage compartment 1609, and is configured to allow selective fluidic communication of the fill tube 1603 between the target material input 1601 and the rinse water storage compartment 1609. A check valve 53 is positioned on the fill tube 1603 to ensure that water does not flow back through the fill tube 1603 toward the storage compartments.

A gas supply 30 is provided in communication with the target chamber 14 to keep the target material under pressure in the target chamber 14 during the bombardment process. In the illustrated embodiment, the target chamber 14 is in fluidic communication with a gas tube 30, which is in turn in fluidic communication with a gas input tube 31 and a vent tube 32. The gas input tube 31 is in fluidic communication with a gas supply 33 such as a gas storage container. In several embodiments, the gas supply 33 is configured to supply an inert gas, such as argon. The vent tube 32 is in fluidic communication with a gas output 34 such as an aperture leading to a gas storage unit or the open air. In certain embodiments, a filter 35 is provided to filter gas flowing through the vent tube 32 to the gas output 34. In the illustrated embodiment, a gas output valve 51 is provided to regulate flow of gas through the vent tube 32 between the gas tube 30 and the gas output 34, and similarly, an inert gas valve 55 is provided to regulate flow of gas through the gas input tube 31 between the gas supply 33 and the gas tube 30.

During the bombardment cycle, first, the target chamber 14 is vented by opening the gas output valve 51, which allows air to flow freely from target chamber 14 through the gas tube 30, the open gas output valve 51, the vent tube 32 and the filter 35 to the gas output 34. Second, the delivery valve is adjusted to connect the load/unload tube 1605 with the fill tube 1603; the water intake valve is adjusted to connect the fill tube 1603 with the target material storage compartment 1601; and a preselected amount of heavy water or other target material is loaded into the target chamber 14 through the fill tube 1603 and the load/unload tube 1605. Third, the delivery valve 54 is closed and the target material in the target chamber 14 is placed under pressure by pumping high pressure argon or other inert gas into the target chamber 14 from the inert gas storage chamber 31. Fourth, once the target material is under pressure, a high-energy particle beam from a cyclotron or other particle accelerator strikes the particle-permeable cover sheet 17 over the target chamber 14. Some of the charged particles from the particle beam pass through the cover sheet 17 and interact with the target material in the target chamber 14, producing the intended radioisotopes. After the bombardment with the particle beam has gone on for a pre-determined length of time, the bombardment ceases. In some embodiments, the target chamber 14 is then vented by closing the inert gas valve 55 and opening the gas output valve 51. The gas output valve 51 is then closed.

Following the bombardment process, the transformed target material (with radioisotopes) is evacuated from the target chamber 14 and directed to a chemical processing unit 40, where the radioisotopes formed within the target material may be combined with other reagents to synthesize a product such as a radiopharmaceutical. In this delivery cycle, the inert gas valve 55 is opened, the delivery valve 54 is adjusted to connect the load/unload tube 1605 with the delivery tube 1607, and pressure from argon or other inert gas pushes the target material (with the radioisotopes) through the load/unload tube 1605 and the delivery tube 1607 to the chemical production unit 40, where, in certain applications, the radioisotopes are reacted with other reagents to synthesize radiopharmaceuticals.

After the delivery cycle, if a rinse cycle is necessary, the target chamber 14 is first vented by opening the gas output valve 51, which allows air to flow freely from target chamber 14 through the gas tube 30, the open gas output valve 51, the vent tube 32 and the filter 35 to the gas output 34. Second, the water intake valve 52 is adjusted to allow a pre-selected amount of sterile rinse water to flow from the rinse water storage compartment 1609 through the fill tube 1603; the delivery valve 54 is positioned to connect the fill tube 1603 and the load/unload tube 1605; the rinse water then flows through the load/unload tube 1605 into the target chamber 14. Third, the rinse water is evacuated from the target chamber 14: the gas output valve 51 is closed and the inert gas valve 55 is opened, allowing inert gas to flow from the inert gas storage container 33 through the gas input tube 31 and the gas tube 30; inert gas under pressure is used to push the rinse water out of the target chamber 14 through the load/unload tube 1605. Fourth, the delivery valve 54 is adjusted to connect the load/unload tube 1605 with the delivery tube 1607; the rinse water is then pushed through the load/unload tube 1605 and the delivery tube 1607 to the chemical production unit 40, where, in certain applications, the rinsed radioisotopes are reacted with other reagents to synthesize radiopharmaceuticals.

Figure 5:
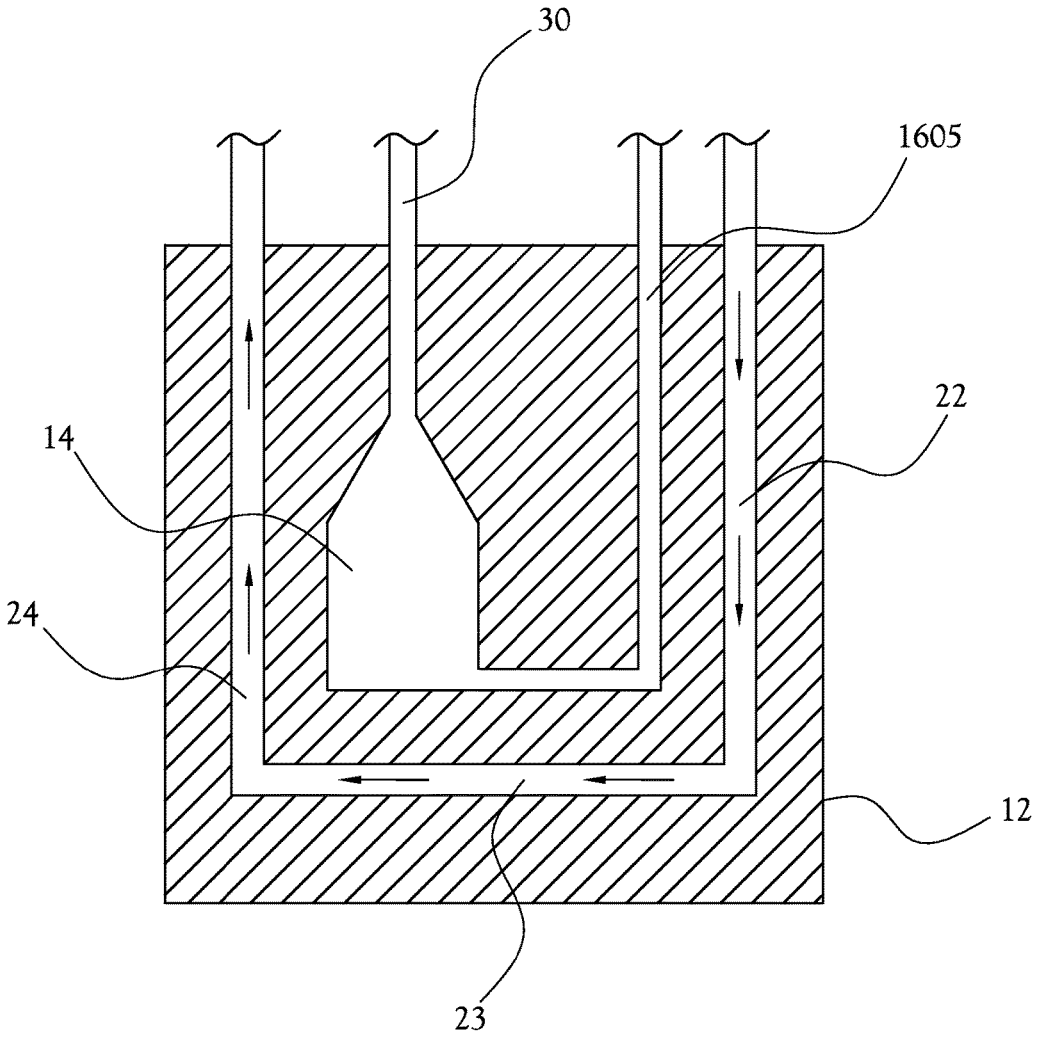
FIG. 5 is a partial view showing the target vessel component of the target assembly shown in FIG. 4.

During the bombardment cycle, and particularly during the bombardment with the particle beam, the target vessel 12 absorbs high amounts of energy from the charged particles; most of this energy is converted into heat. Additionally, the target material, which is being excited by the charged particles and is under high pressure, also becomes heated and transfers some of its heat to the target vessel 12. As shown in FIGS. 4 and 5, to keep the target vessel from overheating, a cooling system 20 is provided in thermal communication with the target vessel 12 to remove heat from the target vessel 12, thereby keeping the target vessel 12 from overheating while the particle beam bombards the target chamber 14. In the illustrated embodiment, the target vessel 12 is connected to a cooling water input 21 and a cooling water output 27 through a cooling water input tube 22 and a cooling water output tube 24, respectively. In certain embodiments, at least one cross tube 23 is provided to connect the cooling water input tube 22 with the cooling water output tube 24. The cooling system 20 is adapted to direct cool water from the cooling water input 21, through the cooling water input tube 22 and through the cooling water output tube 24, to the cooling water output 27 in order to cool the target vessel 12. In some embodiments, water is used as the cooling medium, although other cooling substances are contemplated. Of course, those skilled in the art will recognize other configurations suitable for reducing thermal energy within the target vessel 12 during the bombardment process, and such configurations may be used without departing from the spirit and scope of the present invention.

Figure 6:
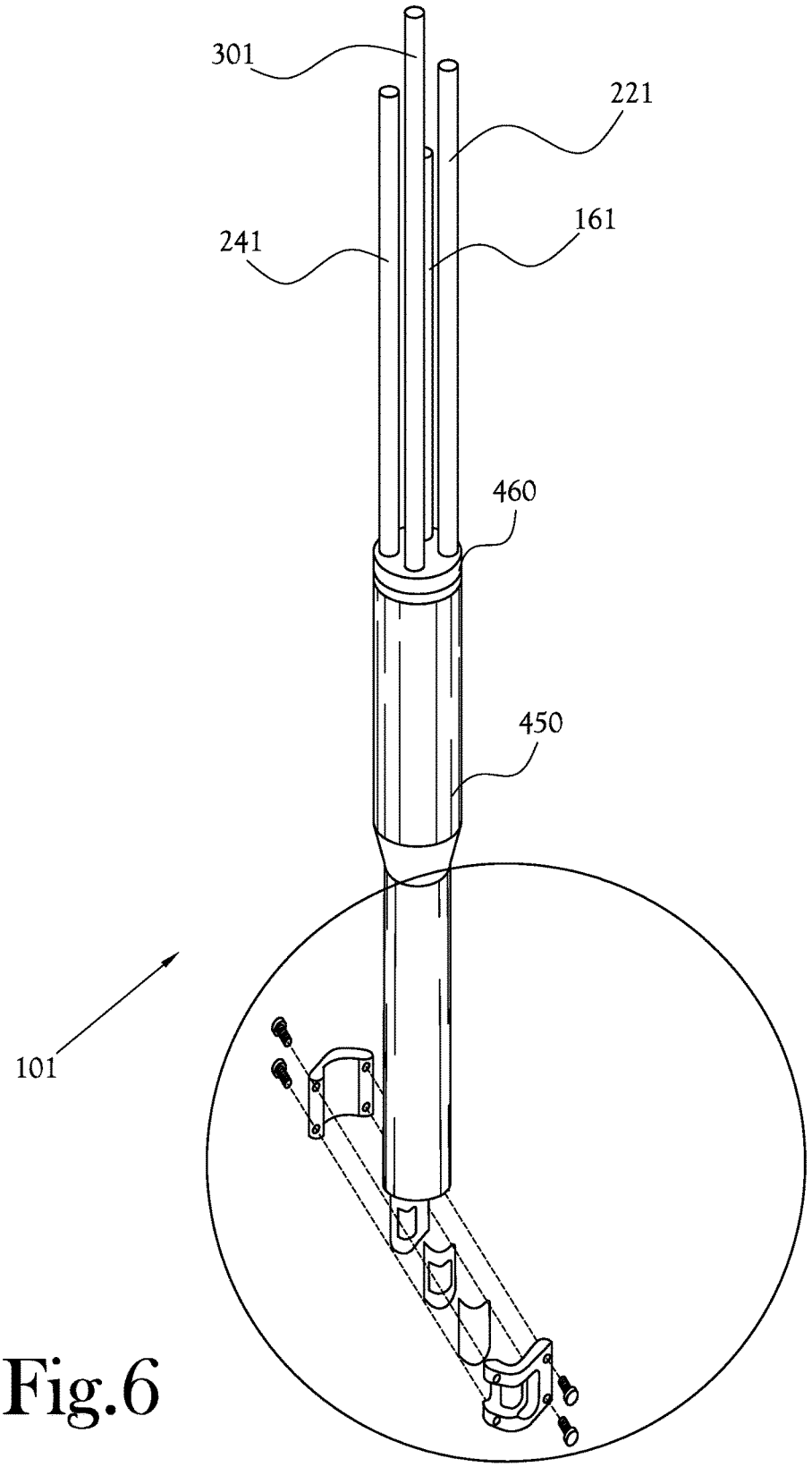
FIG. 6 is a perspective view of another embodiment of the target assembly.
Figure 7:
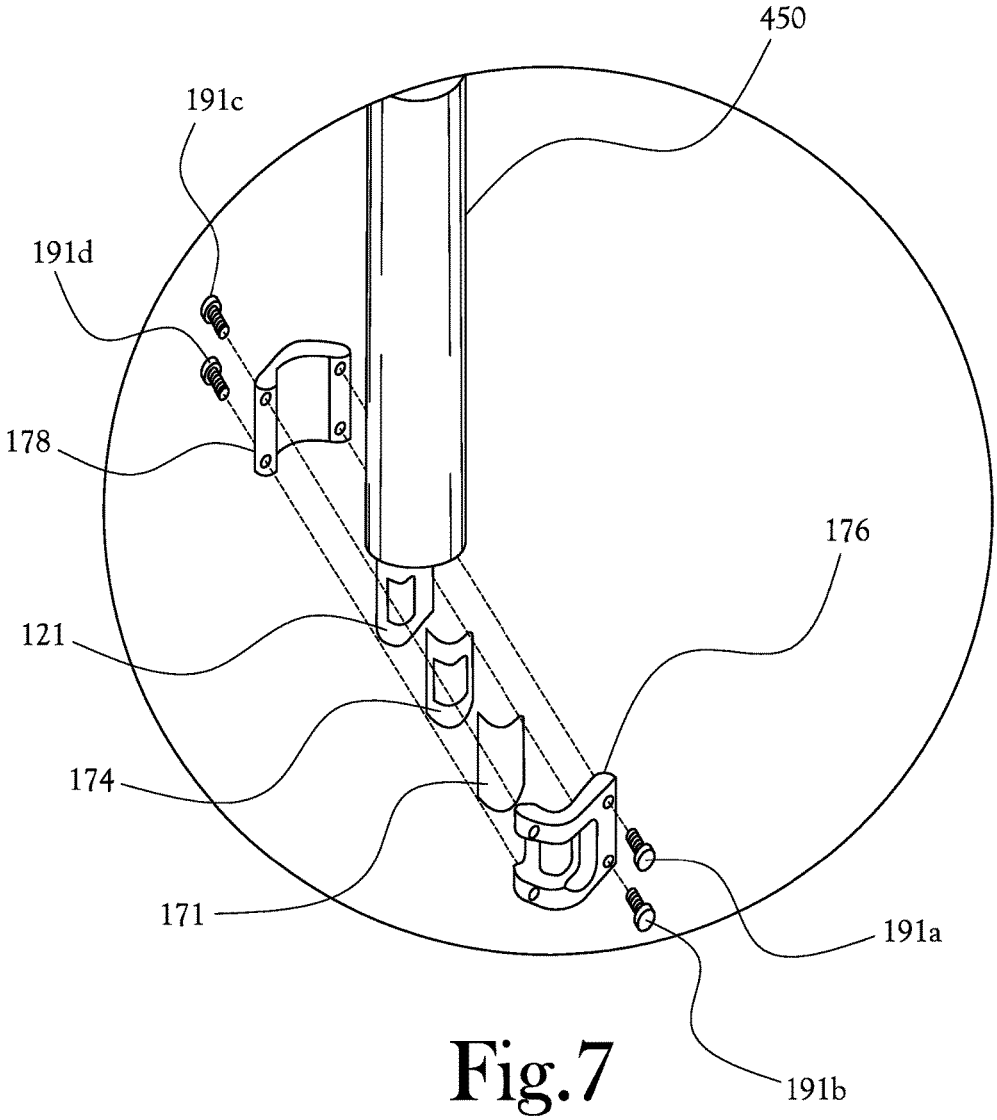
FIG. 7 is a close-up look at an exploded view of the target vessel of the same embodiment shown in FIG. 6.
Figure 8A:
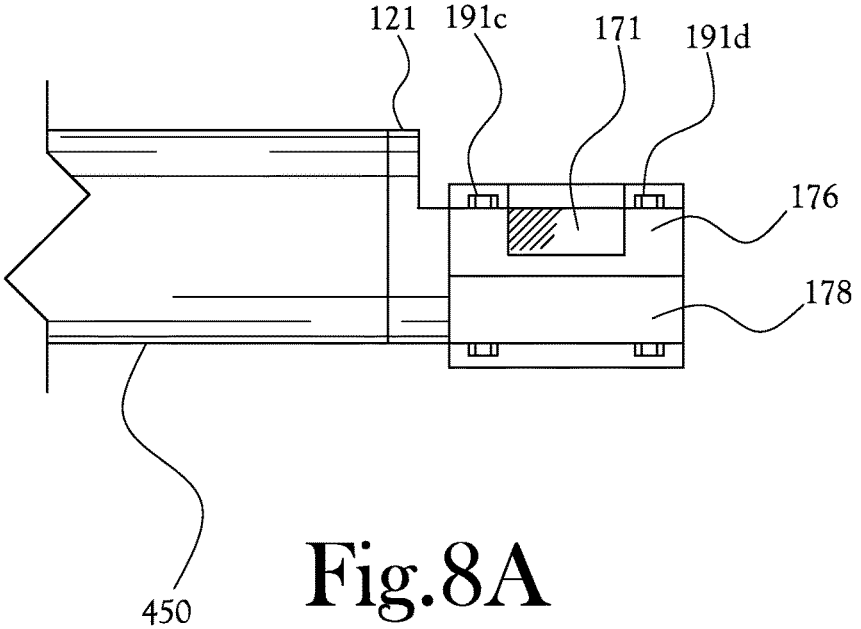
FIG. 8A is a side view of the embodiment shown in FIG. 6.
Figure 8B:
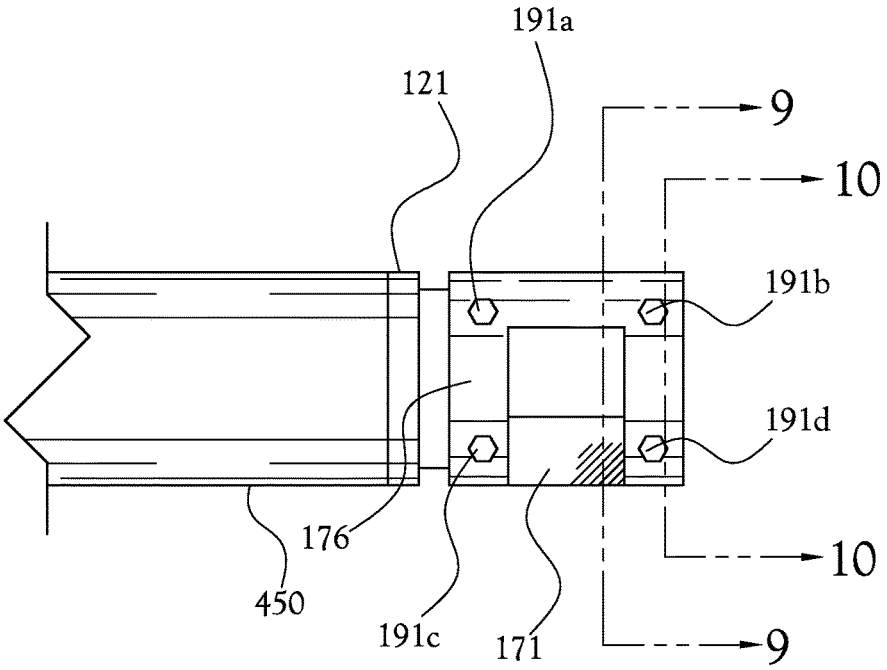
FIG. 8B is another side view of the embodiment shown in FIG. 6, showing the target assembly viewed from a different perspective.
Figure 9:
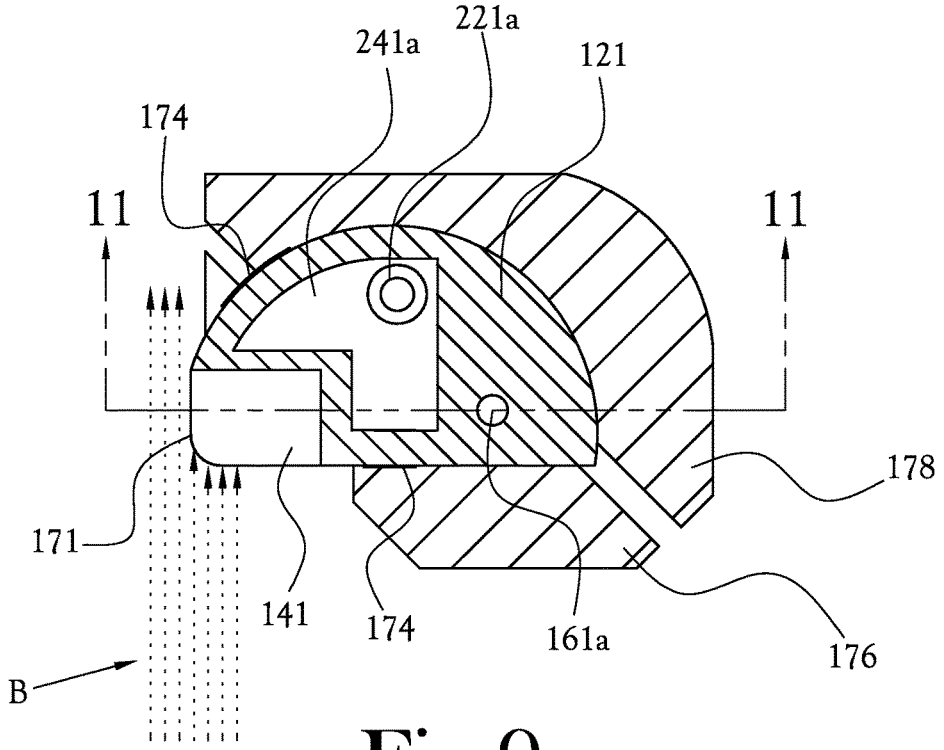
FIG. 9 is a sectional view of the embodiment shown in FIG. 6, taken along the line 9-9 of FIG. 8B.
Figure 10:
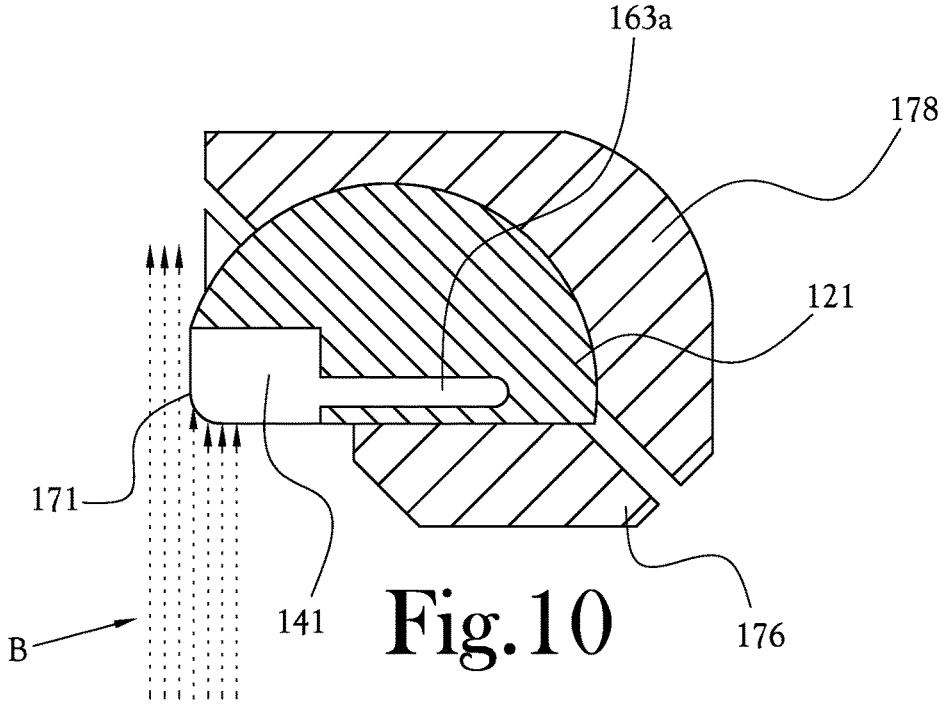
FIG. 10 is a sectional view of the embodiment shown in FIG. 6, taken along the line 10-10 of FIG. 8B.
Figure 11:
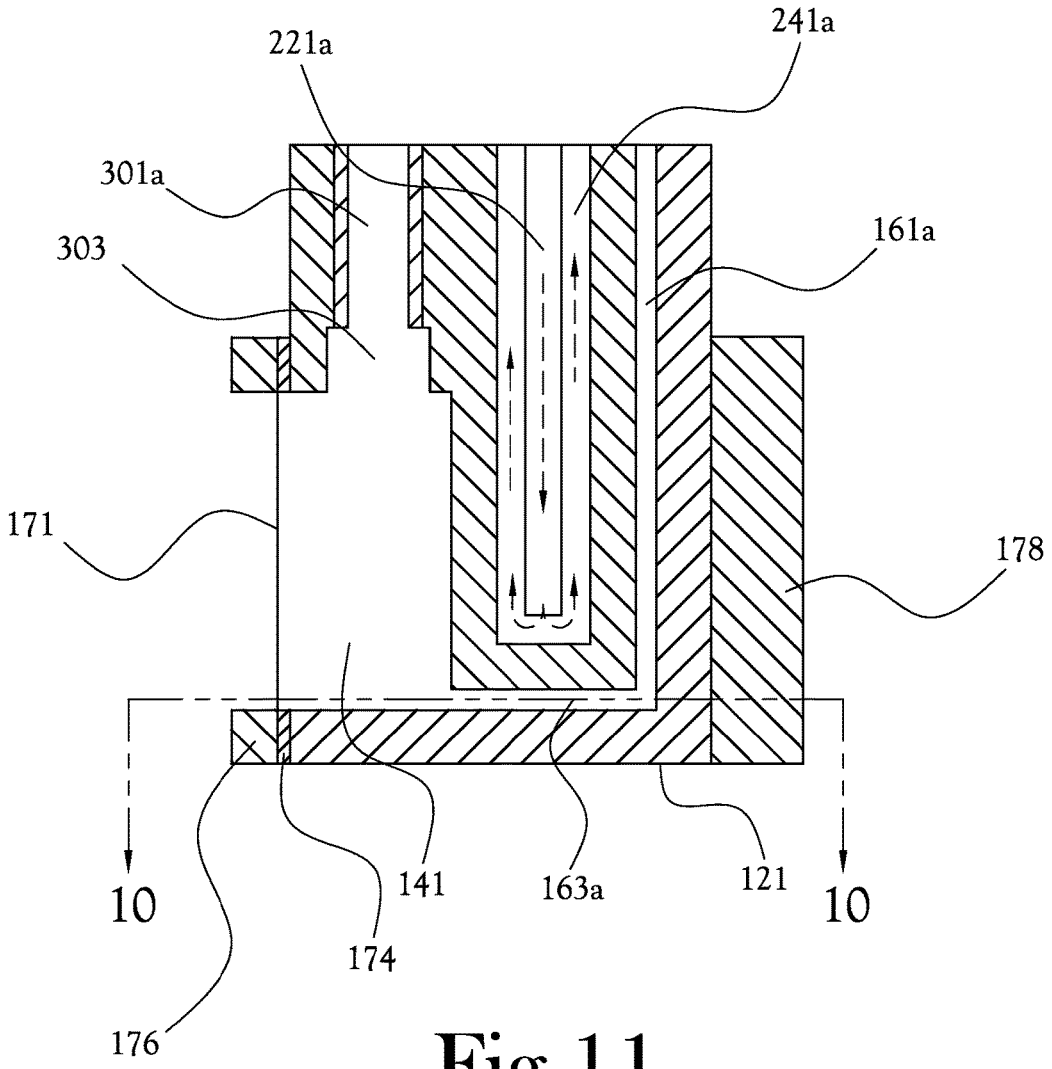
FIG. 11 is a sectional view of the embodiment shown in FIG. 6, taken along the line 11-11 of FIG. 9.

FIGS. 6 through 11 illustrate another example embodiment of a target assembly according to the present invention. FIG. 6 presents a perspective view of the target assembly 101, and FIG. 7 presents a close-up look at an exploded view of the target vessel 121. FIGS. 8A and 8B show side views of the target assembly 101 from two additional perspectives, while FIGS. 9, 10, and 11 provide sectional views of the target vessel 121.

As shown in FIG. 6, the target assembly 101 includes four tubes (collectively, "the supply tubes") that carry substances to and from the target vessel 121. These supply tubes, in the illustrated example embodiment, include a load-unload tube 161 to deliver target material to the target chamber; a gas delivery tube 301 to supply inert gas to the target chamber; and a cooling water input tube 221 and cooling water output tube 241, which together help to circulate water or other fluid through the target vessel 121 in order to keep the temperature of the target vessel 121 within pre-selected limits during the bombardment process.

The target assembly 101 further includes a support tube 450. The smaller-diameter supply tubes 161, 221, 241, 301 travel through the support tube 450 before connecting with the target vessel 121. The supply tubes 161, 221, 241, 301 and support tube 450 collectively comprise a support structure for holding the target vessel 121 in position and for delivering substances (including rinse water, inert gas, target material, and coolant) to the target vessel 121. In some embodiments of the present invention, the target vessel 121 is welded to the support tube 450. In some embodiments of the present invention, the support tube 450 tapers from a larger cross-section diameter to a smaller cross-section diameter at the point where the support tube 450 meets the target vessel 121.

In some embodiments of the present invention, the target assembly 101 further includes a plug 460 that caps that end of the support tube 450 that is opposite the target vessel 121. As shown in FIG. 6, the support tubes 161, 221, 241, 301 enter the support tube 450 through apertures in the plug 460, each tube passing through its respective aperture in a close frictional fit. The plug 460, along with the target vessel 121 welded to the other end of the support tube 460, creates a tight seal on the support tube 450, and in some embodiments the support tube 450 is vacuum sealed.

Each supply tube 161, 221, 241, 301 has at least one corresponding channel within the target vessel 121; generally each supply tube meets its corresponding channel at the surface where the target vessel 121 meets the support tube 450. Thus the load/unload tube 161 travels through the support tube 450 and meets with (and in some embodiments is welded to) a load/unload channel 161*a* within the target vessel 121, seen in FIGS. 9 and 11. The gas supply tube 301 meets a gas supply channel 301*a* within the target chamber, which gives way to a reflux chamber 303 proximate to the target chamber 141, as shown in the section view of FIG. 11. The cooling water input tube 221 meets with an intra-target-vessel cooling water input tube 221*a*, which directs cooling water or fluid toward the bottom of the target vessel 121; there, as shown by the dashed arrows in FIG. 11, the circulating cooling water or fluid fills the cooling water circulation chamber 241*a*, which is carved out of the target vessel 121; the water or fluid then exits the cooling water circulation chamber 241*a* and the target vessel 121 through the cooling water output tube 214, connected to the top of the target vessel 121.

It will be recognized by those with skill in the art that other configurations for a cooling water circulation system are possible and contemplated by this invention, and in particular it is to be noted that the target vessel in some embodiments comprises more than one water or fluid circulation channel.

In some embodiments of the present invention, the body of the target vessel 121 is fabricated from a single piece of material, such as stainless steel or another metal. When the target vessel 121 begins as a single piece of metal, the various volumes within the target vessel 121, such as the target chamber 141 or the load/unload channel 161*a*, may be formed by drilling holes or cavities within the metal. In the illustrated example embodiment, as shown in the sectional views of FIGS. 9, 10, and 11, the target chamber 141 is carved out of the target vessel 121, the vertical load/unload channel 161*a* is drilled into the target vessel 121, and a horizontal supplemental load/unload channel (or "cross-channel") 163*a* is drilled to connect the vertical load/unload channel 161*a* with the target chamber 141.

In some embodiments, the target chamber 141 is carved out of the target vessel 121 and then covered with the thin particle-permeable cover sheet 171. In some embodiments of the present invention, the cover sheet 171 is fabricated from an alloy such as HAVAR® or ARNAVAR. In one particular embodiment, the cover sheet 171 consists of a HAVAR® sheet 0.5 mm thick. In some embodiments, the cover sheet 171 is then welded to the target vessel 121. In some embodiments, such as the illustrated example embodiment in FIGS. 6 and 7, the cover sheet 171 is secured in place in front of the target chamber 141 between a gasket 174 and a front clamp 176; as indicated in the exploded view in FIG. 7, the front clamp 176 works in cooperation with a back clamp 178 to hold the gasket 174 and cover sheet 171 in place against the target chamber 141, such that the cover sheet 171 covers the exposed side of the target chamber 141. The front clamp 176 and the gasket 174 both contain apertures such that, in the area that is the target area of the particle beam during the bombardment process, the cover sheet 171 is the only solid material directly between the particle beam and the target chamber 141. In some embodiments, such as the illustrated example embodiment shown in FIGS. 6 and 7, bolts or other fastening devices 191*a-d* secure the front clamp 176 and the back clamp 178 together.

One unique aspect of this design is that there is no beam post, and the target window or cover sheet 171 wraps around the target face and target chamber 141. This design provides a number of design advantages, including less attenuation of the particle beam B (because there is no beam post), as shown in FIGS. 9 and 10, and less heat being deposited in the part of the window or cover sheet 171 that wraps around (i.e., is substantially parallel to the beam). This reduces the cooling load of the target and allows for higher beam current operation. The larger beam current results in more radioisotope production which improves the yield and allows for a lower energy cyclotron which emits less radiation.

In some embodiments of the present invention, the target chamber 141 is coated with tantalum plating or a similar coating before being covered with the cover sheet 171. Tantalum plating helps to maintain the structural integrity of the target vessel 121 during the bombardment process; tantalum's high melting point and resistance to corrosion insulates the metal of the target vessel body 121 from the heated and volatile target material. It will be recognized by those with skill in the art that other configurations for a target vessel formed from a single piece of metal or other material are possible and contemplated by this invention.

Forming the body of the target vessel 121 from a single piece of material presents advantages over many target assemblies found in the prior art. The target vessel 121 formed from a single piece of material will prove more durable and enjoy a longer useful service life than a comparable target vessel that includes many different parts. Further, with fewer parts making up the target vessel, there is less chance of contamination from components such as the O-rings found in many prior art assemblies. The target vessel described herein also allows for the faster dissipation of residual radiation following the bombardment process. Moreover, the target vessel described herein, by omitting certain materials found in many prior art assemblies, when used does not result in the production of such undesired side products as Cobalt-68.

When the body of the target vessel 121 is fabricated from a single piece of material, it is necessary that the chosen material exhibit certain characteristics. The material must exhibit a tolerance for high heat from the bombardment process. The material must be able to withstand, without deformation that would compromise the integrity of the target vessel or interfere with the operation of the device, pressures of up to 100-250 psi, and possibly higher, from the inert gas used to pressurize the target material in the target chamber 141. Further, the material must conduct heat well in order to transfer heat from the target chamber 141 to the cooling water circulation chamber 241*a*, where circulating water or fluid is available to carry away excess heat. A thermal conductivity value of at least 12 W/(m*K) is recommended. Stainless steel is one such material exhibiting these properties, but other materials are also contemplated.

The bombardment cycle for the target assembly 101 is similar to the bombardment cycle described above for the target assembly 10*a*. The target chamber 141 is vented and the heavy water or other target material is loaded into the target chamber through the load/unload tube 161, the load/unload channel 161*a*, and the cross-channel 163*a*. The contents of the target chamber 141 are placed under pressure by importing pressurized inert gas through the gas supply tube 301 and the gas supply channel 301*a*. The target material is then altered by focusing a high-energy particle beam on the cover sheet 171 covering the target chamber 141. As said above, the target material selected in many embodiments is heavy water. During this bombardment process, the bombardment of the heavy water in the target chamber 141 turns some of the heavy water into steam. This steam travels into the reflux chamber 303, where, being out of the direct path of the particle beam and subject to cooling from the water circulation system and pressure from the pressurized gas, the steam condenses back into water.

As noted above, in some embodiments of the present invention, the cover sheet 171 is fabricated from an alloy such as HAVAR® or ARNAVAR. In one particular embodiment, the cover sheet 171 consists of a HAVAR® sheet 0.5 mm thick. In this embodiment, a proton beam strikes the HAVAR® cover sheet 171 with approximately 7.5 MeV energy; the cover sheet 171 allows 6.8 MeV to pass through to interact with the heavy water. In this embodiment, the heavy water is kept under approximately 100 to 250 psi of pressure from the inert gas pumped in through the gas supply tube 301 and gas supply channel 301*a*. This pressure raises the boiling point of the heavy water and also helps to compress the target material within the target chamber 141, thereby ensuring more interaction between the charged particles and the O-18 atoms, improving the yield of radioisotopes. Those of skill in the art will recognize that the particle-beam energies employed here, on the order of 7.5 Watts with a 1 micro-Amp current to produce a proton beam with 7.5 MeV energy, and the pressures involved, on the order of 100 to 250 psi, are considerably lower than the requirements for many systems in the prior art.

As noted above, a target assembly according to the present general inventive concept generally encompasses a window piece or cover sheet that wraps around the target chamber and the target body, so that, when the target assembly is maneuvered into a particular rotational position relative to the path of the beam of high-energy particles, part of the window piece is substantially perpendicular to the path of the beam and part of the window piece is substantially parallel to the path of the beam, and the beam impinges near where the window piece curves to wrap around the target chamber and target body. This design of the target assembly results in less attenuation of the particle beam as it impacts the target body. In such a target assembly, clamps do not shadow the beam.

While the present invention has been illustrated by description of one embodiment, and while the illustrative embodiment has been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A target assembly to produce a radioisotope from a target material comprising:

a target vessel having a body fabricated from a single piece of material, said target vessel defining a target chamber to hold the target material and to position the target material in the path of a beam of charged particles, whereby when the charged particles interact with the target material in said target chamber, at least one radioisotope is formed; and a support structure to deliver target material to said target chamber, to pressurize the target material within said target chamber, to remove radioisotopes from said target chamber, and to cool said target vessel, wherein said target chamber defines a window at least partially covered by a sheet of particle-permeable material, said sheet being positioned to allow the beam of charged particles to penetrate the sheet to bombard the target material, said sheet wrapping around said target chamber and having a first part that at least partially covers one side of the target chamber and is substantially perpendicular to the path of the beam and a second part that covers a second side of the target chamber and is substantially parallel to the path of the beam, and wherein the target assembly is configured to receive the beam at a curved portion of the sheet between the first part and the second part and to allow a portion of the beam to propagate past the second part of the sheet.

2. The target assembly of claim 1 wherein said sheet of particle-permeable material is welded to said target vessel.

3. The target assembly of claim 1 wherein said sheet of particle-permeable material is fabricated from a material selected from the group consisting of HAVAR, ARNAVAR, and aluminum.

4. The target assembly of claim 3 wherein said sheet of particle-permeable material is secured to said target vessel by a clamp and gasket.

5. The target assembly of claim 1 wherein said body of said target vessel is formed from stainless steel, tantalum, or molybdenum.

6. The target assembly of claim 1 wherein said body of said target vessel is formed from a material capable a withstanding without compromising deformation pressures of up to 250 pounds per square inch.

7. The target assembly of claim 1 wherein said body of said target vessel is formed from stainless steel, tantalum, or molybdenum.

8. The target assembly of claim 1 wherein said body of said target vessel is formed a material exhibiting thermal conductivity of at least 12 Watts per meter per Kelvin.

9. A target assembly to produce a radioisotope from a target material comprising:

a target vessel having a body fabricated from a single piece of material;

said target vessel including a target chamber for holding the target material and for positioning the target material in the path of a beam of charged particles, whereby when the charged particles interact with the target material in said target chamber, radioisotopes are formed, said target chamber being covered on at least one side by a window piece fabricated from material configured to withstand the impact of a beam of charged particles, said window piece being positioned to cover an area directly in the path of the beam of charged particles, said window piece being configured to permit the through passage of at least some charged particles through said window piece to interact with the target material in said target chamber, said window piece wrapping around the target chamber, the window piece having a first part that covers one side of the target chamber and is substantially perpendicular to the path of the beam and a second part that covers a second side of the target chamber and is substantially parallel to the path of the beam, wherein the target assembly is configured to receive the beam at a curved portion of the window piece between the first part and the second part and to allow a portion of the beam to propagate past the second part of the window piece; and a support structure for delivering target material to said target chamber, for pressurizing the target material within said target chamber, for removing radioisotopes from said target chamber, and for cooling said target vessel.

10. The target assembly of claim 9 wherein said window piece is fabricated from HAVAR.

11. The target assembly of claim 9 wherein said window piece is fabricated from ARNAVAR.

12. The target assembly of claim 9 wherein said body of said target vessel is formed from stainless steel, tantalum, or molybdenum.

13. The target assembly of claim 9 wherein said target vessel is fabricated from material capable of withstanding deformation pressures of up to 250 pounds per square inch.

14. The target assembly of claim 9 wherein said target vessel is fabricated from material exhibiting a thermal conductivity of at least 12 Watts per meter per Kelvin.

15. A target assembly to produce a radioisotope from a target material, comprising:

a target chamber to hold the target material and to position the target material in the path of a beam of high-energy particles, and a window piece that wraps around the target chamber, the window piece having a first part that covers one side of the target chamber and is substantially perpendicular to the path of the beam and a second part that covers a second side of the target chamber and is substantially parallel to the path of the beam, wherein the target assembly is configured to receive the beam at a curved portion of the window piece between the first part and the second part and to allow a portion of the beam to propagate past the second part of the window piece.

* * * * *